US008684351B2

(12) United States Patent
Akimatsu

(10) Patent No.: US 8,684,351 B2
(45) Date of Patent: Apr. 1, 2014

(54) DOCUMENT HOLDING DEVICE FOR AN IMAGE PROCESSING SYSTEM

(75) Inventor: Takayuki Akimatsu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/241,958

(22) Filed: Sep. 23, 2011

(65) Prior Publication Data

US 2012/0080839 A1 Apr. 5, 2012

(30) Foreign Application Priority Data

Sep. 30, 2010 (JP) ..... 2010-220498

(51) Int. Cl.
*B65H 1/00* (2006.01)

(52) U.S. Cl.
USPC ..... 271/171

(58) Field of Classification Search
USPC ..... 271/145, 171; 399/393
See application file for complete search history.

(56) References Cited

U.S. PATENT DOCUMENTS 5,611,528 A * 3/1997 Nakamura et al. ..... 271/164
7,464,927 B2 * 12/2008 Ito et al. ..... 271/171
7,883,085 B2 * 2/2011 Asada et al. ..... 271/171
8,398,074 B2 * 3/2013 Uchino ..... 271/171
2007/0194517 A1 * 8/2007 Nose et al. ..... 271/171
2008/0205952 A1 8/2008 Murai
2008/0292382 A1 * 11/2008 Asada et al. ..... 400/642
2010/0123283 A1 * 5/2010 Hayakawa ..... 271/109

FOREIGN PATENT DOCUMENTS

JP 2004-051363 A 2/2004
JP 2006-117382 A 5/2006
JP 2008-213946 A 9/2008
JP 2008-303039 A 12/2008

OTHER PUBLICATIONS

Notice of Reasons for Rejection issued in Japanese Application No. 2010-220498 mailed Jan. 15, 2013.

* cited by examiner

*Primary Examiner* — Jeremy R Severson
(74) *Attorney, Agent, or Firm* — Banner & Witcoff, Ltd.

(57) ABSTRACT

A first rack of a pair of document guides slides in pressing contact against a pinion due to contact with a protrusion. As a result, the first rack is subjected to a larger sliding resistance than when the protrusion is not provided. When one of the document guides is operated, the operating force transmits directly to the first rack. Therefore, if a large force corresponding to the sliding resistance increased by the protrusion is applied, the first rack can be slid. When the other document guide is operated, the operating force transmits to the first rack through the pinion. Therefore, the sliding resistance increased by the protrusion increases due to the gear efficiency of the pinion.

11 Claims, 6 Drawing Sheets

DOCUMENT HOLDING DEVICE FOR AN IMAGE PROCESSING SYSTEM

CROSS REFERENCE TO RELATED APPLICATION

This application claims priority from Japanese Patent Application No. 2010-220498, filed on Sep. 30, 2010, the entire subject matter of which is incorporated herein by reference.

BACKGROUND

Aspects of the present disclosure relate to a document holder, an image scanner including the document holder, and an image forming apparatus including the document holder.

Some current image scanners include an automatic document feeder (hereinafter abbreviated as ADF), when documents to be fed are placed on a document tray, the placed documents are generally positioned using document guides.

More specifically, when ADFs include document guides that are movable such that their positions can be changed in accordance with the document width. For example, the positions of the documents guides may be adjustable by sliding the document guides in a direction (hereinafter also referred to as document width direction) perpendicular to the direction in which documents are fed by the ADF.

The pair of document guides, with one guide disposed on each side in the document width direction, are provided with racks sliding together with the document guides and a pinion meshing with both of the racks. These form an interlock mechanism that, when one of the document guides is slid, cause the other document guide to also slide in synchronization therewith.

In some arrangements, an ADF is mounted on a flatbed image scanner (hereinafter, flatbed will be abbreviated as FB). This type of FB image scanner generally includes a main body portion with upper surface configured to serve as a placing surface on which a document can be placed, and to scan an image from the document placed on the placing surface while moving an image sensor along the placing surface. Above the main body portion, an opening and closing portion is provided that is openable and closable relative to the main body portion. When the opening and closing portion is closed, the opening and closing portion functions as a cover that covers the placing surface.

According to some configurations, the ADF may be incorporated in the opening and closing portion. When documents are fed by the ADF with the image sensor at a predetermined scanning position, the documents pass through a position facing the image sensor, and images can be scanned from the documents with the image sensor.

In the case where the above-described ADF is incorporated in an opening and closing portion, the sliding direction of the document guides may become inclined relative to the horizontal plane when the opening and closing portion is opened, depending on the relationship between the center of rotation of the opening and closing portion and the sliding direction of the document guides.

For example, in the case where the opening and closing portion rotates about an axis extending in a direction perpendicular to the sliding direction of the document guides, and when the opening and closing portion is opened, one of the document guides becomes higher than the other document guide. This situation also results in the sliding direction of the document guides becoming inclined relative to the horizontal plane.

If documents are placed on the document tray at this time, the load of the documents acts on the lower document guide. For this reason, if the operating load required to slide the document guides is too small, the load of the documents causes the document guides to slide. As a result, the documents slide down from the proper position together with the lower document guide.

Such a problem can be avoided by using a structure in which a large operating load is required to slide the document guides. In this case, the document guides do not slide easily when they are subjected to a small load.

However, if the operating load required to slide the document guides is too large, a large operating load is required when the user operates the document guides to slide them, and therefore the operability of the document guides is lowered.

SUMMARY

Aspects of the disclosure include a sheet holder (e.g., a sheet feeder) in which sheet guides do not slide easily when the load of sheets acts on the sheet guides, and the sheet guides can be easily slid when the user operates the sheet guides. In one or more arrangements, the sheet feed may be included as part of an image scanner.

Aspects described herein provide an sheet holder (e.g., a feeder). The sheet holder may include a sheet tray with an upper surface on which sheets can be placed, a sheet conveying mechanism configured to convey the sheets placed on the upper surface from the sheet tray along a predetermined path of conveyance to a predetermined destination, a pair of sheet guides including first and second sheet guides provided on the upper surface of the sheet tray and slidable in a direction (e.g., along an axis) perpendicular to the sheet conveying direction on the upper surface of the sheet tray. The slidable pair of sheet guides may therefore be operated such that the distance therebetween may be changed. The sheet feeder may further include an interlock mechanism that is configured to cause, when one of the pair of first and second sheet guides is slid, the pair of first and second sheet guides to slide in opposite directions. In one or more examples, The sheet tray, the sheet conveying mechanism, the pair of first and second sheet guides, and the interlock mechanism may be assembled to a movable body that is pivotable or rotatable in such a direction that the angle between a sliding direction of the pair of first and second sheet guides and the horizontal plane increases and decreases. In some examples, when the movable body is rotated in such a direction that the angle between the sliding direction and the horizontal plane increases, the load of the sheets acting on the sheet guides increases with increasing inclination of the sheet tray. Additionally, in one or more examples, the first sheet guide is configured to have a first operating load, the first operating load being required to move the first sheet guide, and the second sheet guide is configured to have a second operating load, wherein the second operating load is required to move the second sheet guide and is greater than the first operating load. Moreover, according to some examples, the sheet holder or feeder may be included as part of an image scanner and/or an image forming device such as a printer.

DETAILED DESCRIPTION

An illustrative embodiment will be described in detail with reference to the accompanying drawings. A sheet feeder or holder according to illustrative aspects of disclosure may, for example, apply to a feeder mechanism in multifunction device 1 as shown in FIG. 1.

Structure of Multifunction Device

Figure 1A:
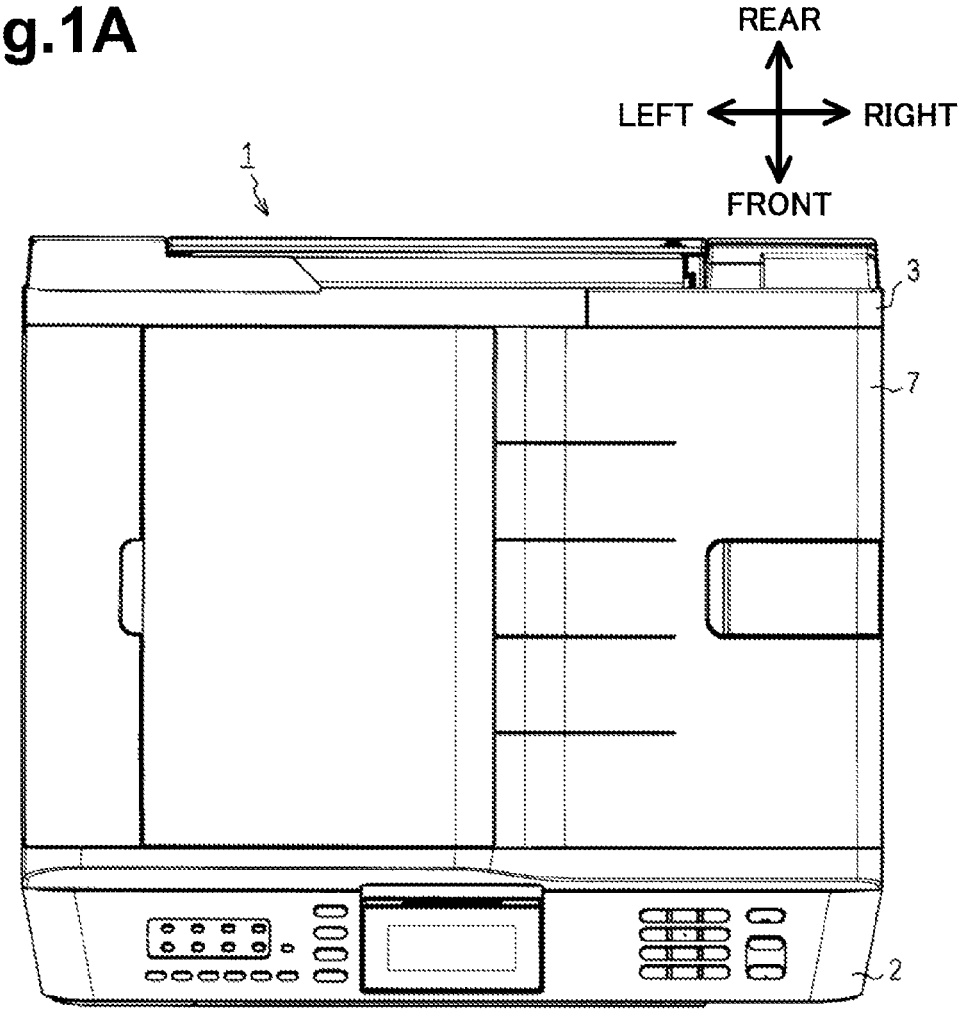
FIG. 1A is a plan view of an example multifunction device.
Figure 1B:
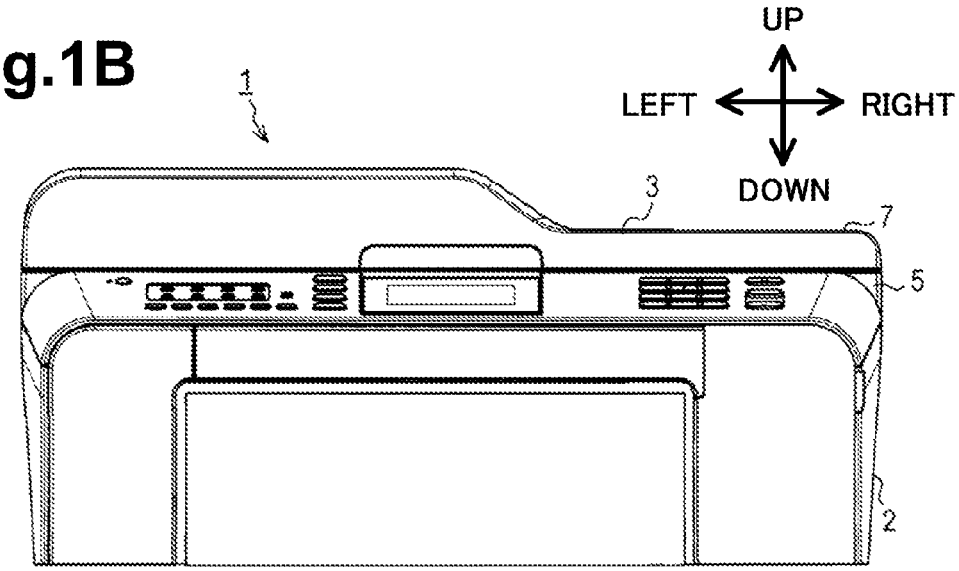
FIG. 1B is a front view of the multifunction device shown in FIG. 1A.

The multifunction device 1 shown in FIGS. 1A and 1B has, in addition to the function as an image scanner (scanning function), other functions (for example, a printing function, a copying function, and a facsimile transmitting and receiving function). In the following description, the positional relationship of parts of the multifunction device 1 are described using up, down, left, right, front, and rear directions as indicated in the figures.

The multifunction device 1 has a main unit 2 and a scanner unit 3 mounted on top of the main unit 2. The scanner unit 3 has such a structure allowing opening and closing relative to the main unit 2 by rotating the front edge about the back edge upward and downward. The scanner unit 3 also functions as a cover that covers an opening in the top of the main unit 2.

In one example arrangement, the scanner unit 3 has such a structure that an ADF is added to an FB image scanner, and includes an FB main body 5, and an ADF portion 7 that covers the upper surface of the FB main body 5.

The ADF portion 7 is configured to be opened and closed relative to the FB main body 5 by rotating the front edge about the back edge upward and downward, and functions as a cover that covers the upper surface of the FB main body 5 (the upper surface of an FB glass plate 17 to be described later). Moving the ADF portion 7 from the closed position shown in FIGS. 1A and 1B to an open position (not shown) using this opening and closing mechanism brings the multifunction device 1 into a state where a document (e.g., a type of sheet) can be placed on the upper surface of the FB main body 5.

The ADF portion 7 has, separately from the above rotatable structure, a structure movable relative to the FB main body 5 in the vertical direction. By lifting the ADF portion 7, a relatively thick document can be placed between the FB main body 5 and the ADF portion 7.

Details of Scanner Unit

Figure 2:
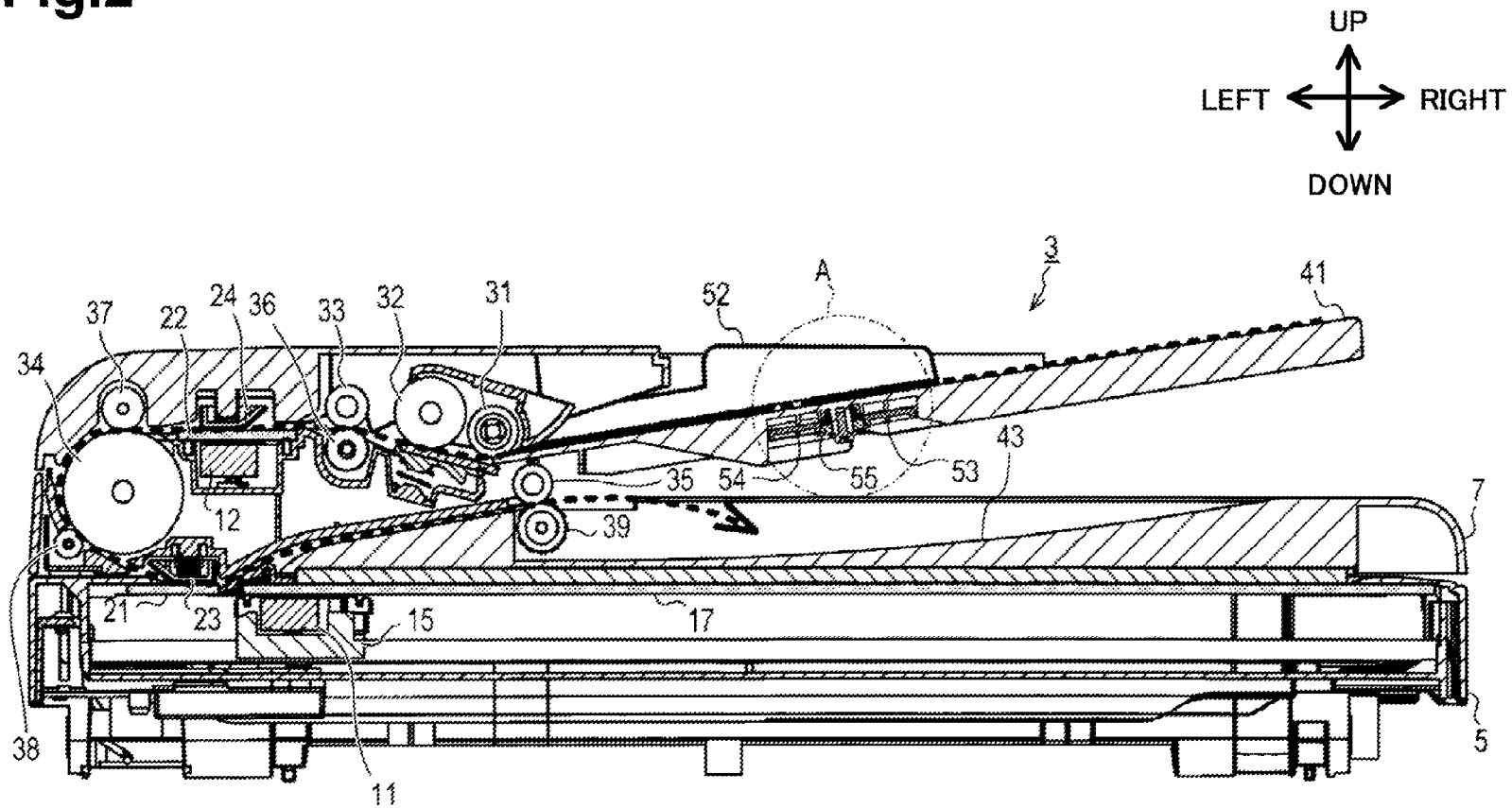
FIG. 2 is a vertical sectional view of an example scanner unit.

Next, the scanner unit 3 will be described in more detail with reference to FIG. 2.

The scanner unit 3 includes a first image sensor 11 and a second image sensor 12. In this embodiment, the first image sensor 11 and the second image sensor 12 are both contact image sensors. In other arrangements, the first image sensor 11 and the second image sensor 12 may be different types of image sensors.

In the scanner unit 3, the first image sensor 11 is mounted on a carriage 15 provided in the FB main body 5 and is configured to reciprocate together with the carriage 15 in the left-right direction. Above the path of movement of the first image sensor 11, an FB glass plate 17 is disposed.

In the case where the scanner unit 3 is used as an FB scanner, a document or other type of sheet is placed on the FB glass plate 17. The first image sensor 11 can scan an image from the document by repeatedly scanning a plurality of pixels arranged in the main scanning direction (the front-back direction of the multifunction device 1) while moving in the sub-scanning direction (the left-right direction of the multifunction device 1).

Above the path of movement of the first image sensor 11 and to the left of the FB glass plate 17, a first ADF glass plate 21 is disposed. Above the second image sensor 12, a second ADF glass plate 22 is disposed. Above the first ADF glass plate 21, a first document (or sheet) holder 23 is disposed. Above the second ADF glass plate 22, a second document (or sheet) holder 24 is disposed.

In addition, the scanner unit 3 includes a supply roller 31, a separation roller 32, a relay conveying roller 33, a main conveying roller 34, and an ejection roller 35, all of which may be driven by power transmitted from a power source. The scanner unit 3 includes a first pinch roller 36, a second pinch roller 37, a third pinch roller 38, and a fourth pinch roller 39, which are configured to nip a document in cooperation with the rollers 31 to 35 and are driven or rotate to follow the document being conveyed.

In the case where the scanner unit 3 is used as an ADF scanner, the above-described rollers are driven. At that time, documents placed on the document tray 41 are conveyed along the path of conveyance shown by a dashed line in FIG. 2. Specifically, documents placed on the document tray 41 are sent by the supply roller 31 to the downstream side in the conveying direction, and one of the documents (e.g., a single sheet) is separated by the separation roller 32.

The document separated by the separation roller 32 is sent by the relay conveying roller 33 to the main conveying roller 34. The document is caused to make a U-turn along the circumference of the main conveying roller 34. The document then sent by the main conveying roller 34 is sent by the ejection roller 35 to the downstream side in the conveying direction. The document is subsequently ejected onto the ejection tray 43.

In the case where the scanner unit 3 is used as an ADF scanner, the first image sensor 11 moves to a position immediately below the first document holder 23 in the left-right direction and comes to rest at that position. The second image sensor 12 is disposed at a position immediately below the second document holder 24 in the left-right direction and, in some arrangements, does not move from the position in the left-right direction.

The document conveyed by the above rollers passes between the second ADF glass plate 22 and the second document holder 24 after being sent by the relay conveying roller 33 and before reaching the main conveying roller 34. At that time, the second image sensor 12 scans an image from the reverse side of the document by repeatedly scanning a plurality of pixels arranged in the main scanning direction (the front-back direction of the multifunction device 1) from the document moving in the sub-scanning direction (conveying direction).

The document passes between the first ADF glass plate 21 and the first document holder 23 after being sent by the main conveying roller 34 and before reaching the ejection roller 35. At that time, the first image sensor 11 scans an image from the face of the document by repeatedly scanning a plurality of pixels arranged in the main scanning direction (the front-back direction of the multifunction device 1) from the document moving in the sub-scanning direction (conveying direction).

Details of Document Guides

Next, document guides will be described with reference to FIGS. 3A, 3B, 4, 5A, and 5B.

Figure 3B:
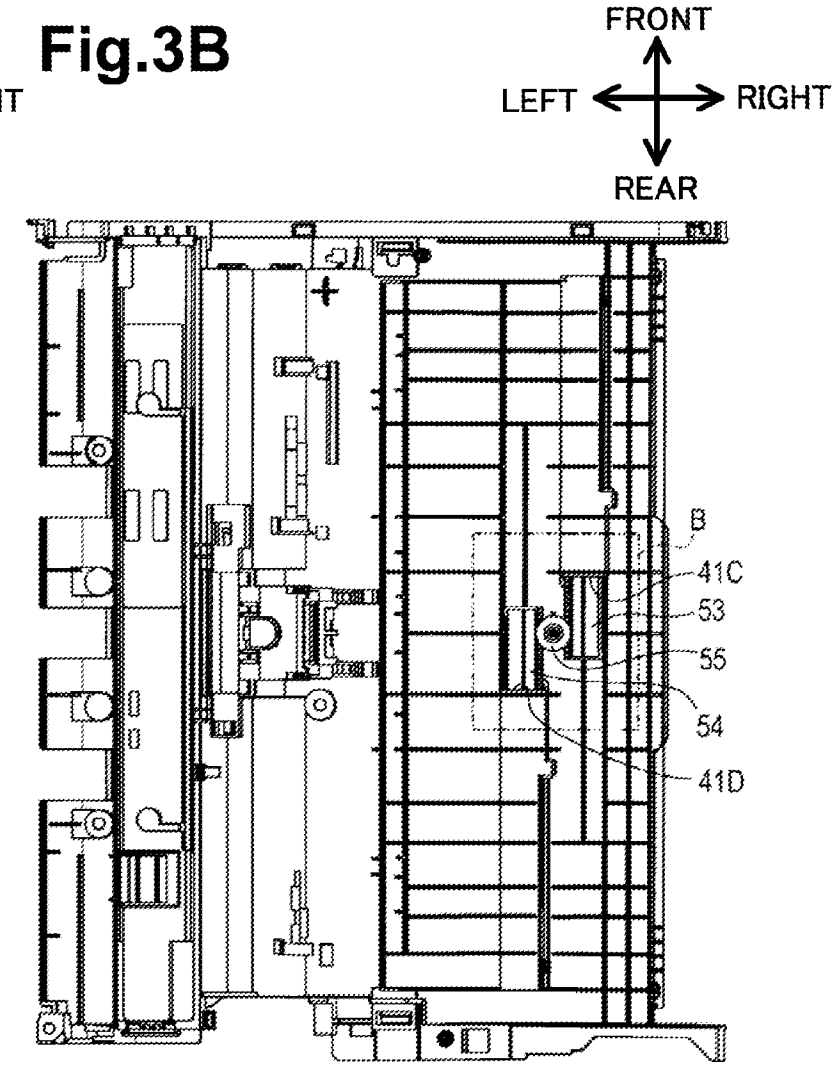
FIG. 3B is a diagram of the document guides and document tray of FIG. 3A as viewed from below.
Figure 3A:
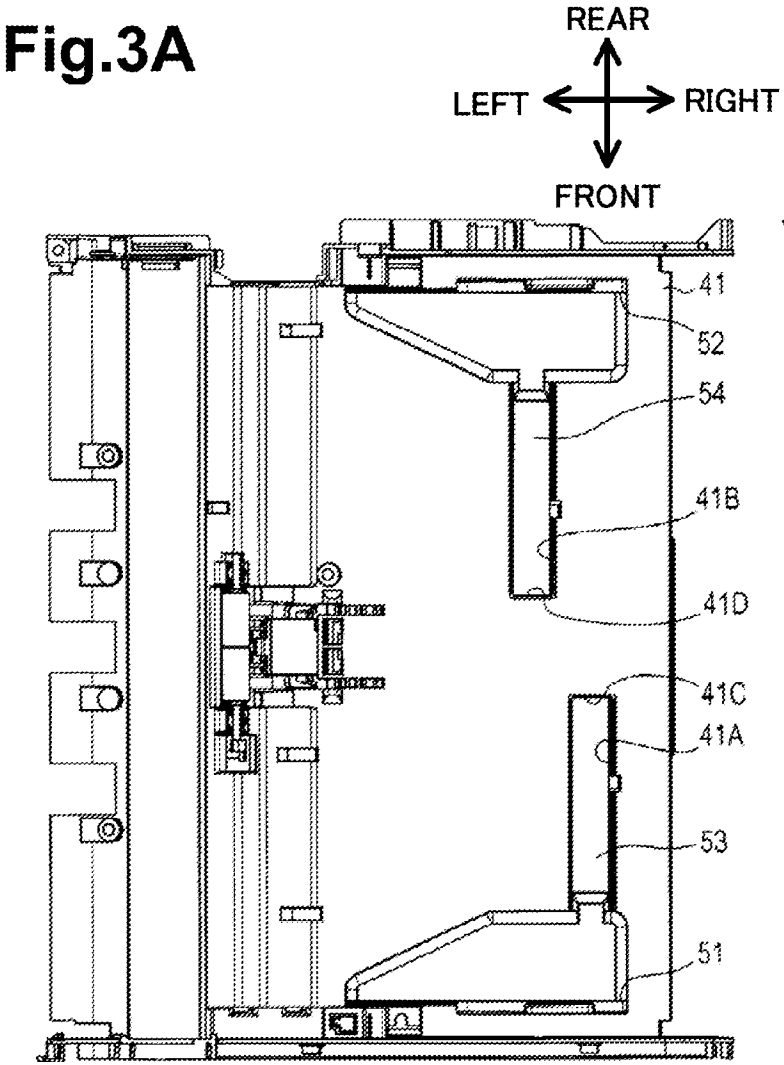
FIG. 3A is a diagram of example document guides and an example document tray as viewed from above.

As shown in FIG. 3A, on the upper surface of the document tray 41, a pair of guides including the first and second document guides 51 and 52 are spaced apart in a direction (the front-back direction in FIG. 3A) perpendicular to the document conveying direction (the left-right direction in FIG. 3A) on the upper surface of the document tray 41.

The first document guide 51 is provided with a first rack 53 formed, in some instances, integrally with the document guide 51, and the second document guide 52 is provided with a second rack 54 formed, in some arrangements, integrally with the document guide 52.

The first rack 53 and the second rack 54 are fit in grooves 41A and 41B formed in the document tray 41 and are slidable in the front-back direction along the grooves 41A and 41B. When the first rack 53 and the second rack 54 slide, the document guides 51 and 52 also slide together with the first rack 53 and second rack 54 in the front-back direction.

At the back end of the groove 41A, an opening 41C is formed. At the front end of the groove 41B, an opening 41D is formed. As shown in FIG. 3B, the ends of the first rack 53 and the second rack 54 are passed through the openings 41C and 41D and are exposed on the lower surface of the document tray 41. On the lower surface of the document tray 41, a pinion 55 is provided that meshes with both the first rack 53 and the second rack 54.

Figure 4:
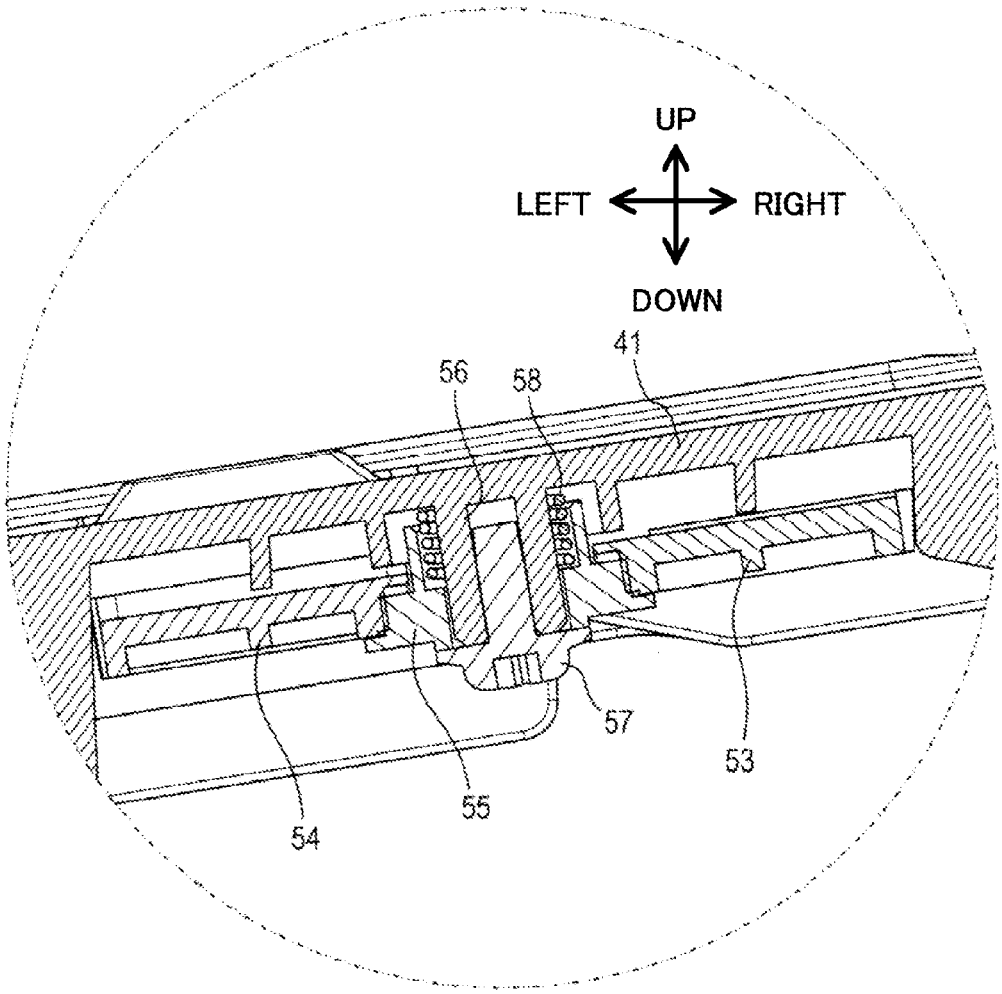
FIG. 4 is an enlarged view of part A shown in FIG. 2.

As shown in the enlarged view of FIG. 4, the pinion 55 is fit on a boss 56 provided on the lower surface of the document tray 41 and is rotatable about the boss 56. At the tip of the boss 56, a flanged screw 57 is attached. This flanged screw 57 prevents the pinion 55 from coming off of (e.g., detaching from) the boss 56.

A compression spring 58 is also fitted on the boss 56. In at least some arrangements, the compression spring 58 presses the pinion 55 against the flanged screw 57, thereby producing frictional resistance that interferes with the rotation of the pinion 55.

Figure 5B:
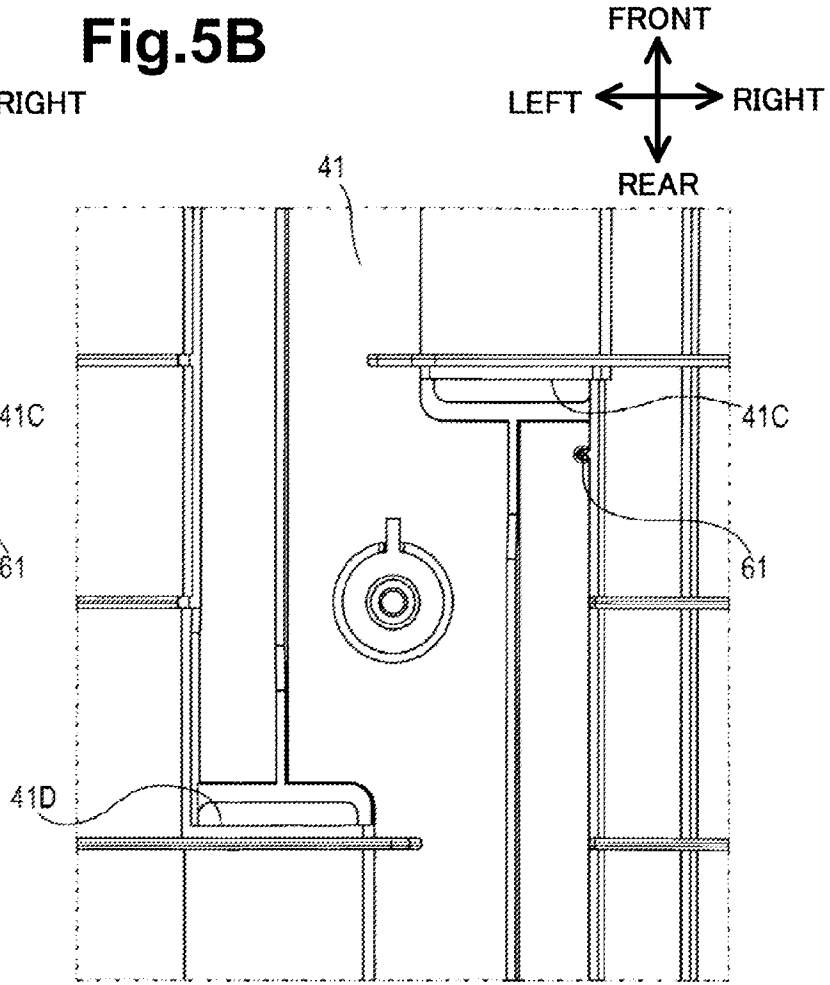
FIG. 5B is a diagram showing an example state where the rack and pinion shown in FIG. 5A are removed.
Figure 5A:
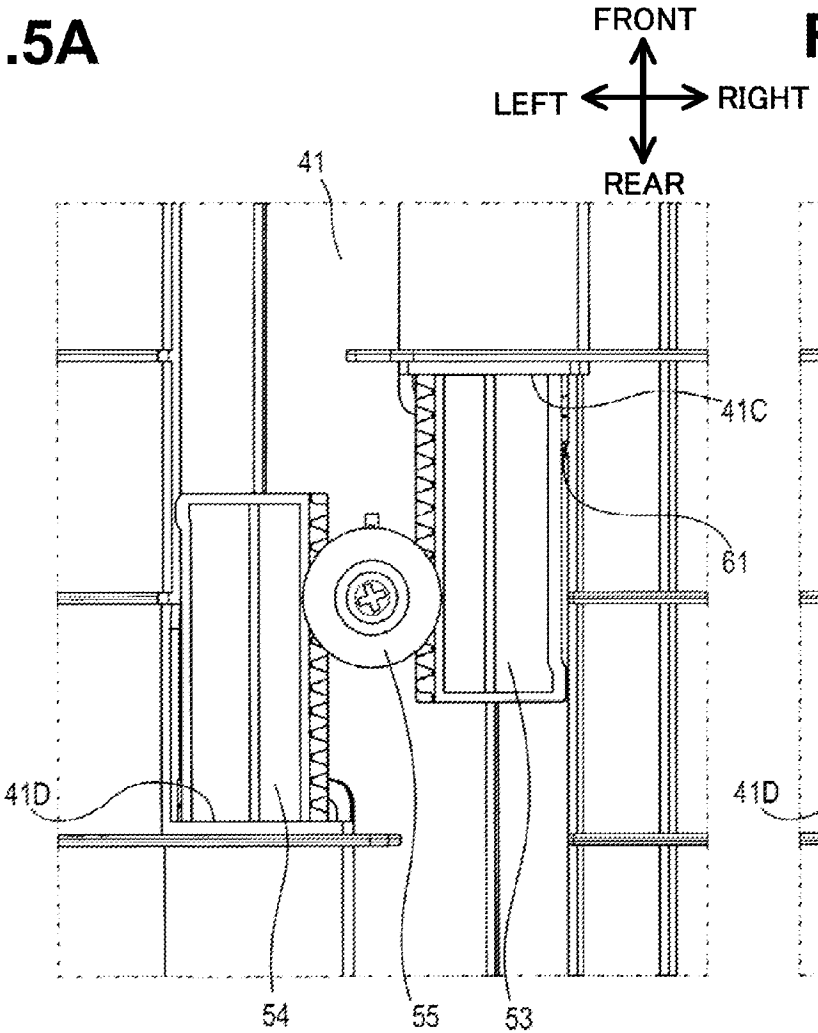
FIG. 5A is an enlarged view of part B shown in FIG. 3B.

As shown in FIGS. 5A and 5B, on the lower surface of the document tray 41, a protrusion 61 is formed that protrudes toward the first rack 53. This protrusion 61 is in pressing contact against the part of the first rack 53 opposite to the part where teeth meshing with the pinion 55 are formed. In one example, the height of the protrusion 61 is 2 mm or less.

For this reason, the first rack 53 slides in pressing contact against the pinion 55 due to the contact with the protrusion 61, and as a result, the first rack 53 is subjected to a larger sliding resistance than in the case where the protrusion 61 is not provided. In some arrangements, protrusion 61 may protrude from the first rack 53 toward the portion of the sheet tray on which the first rack 53 is configured to slide rather than protruding from the sheet tray.

However, providing such a protrusion 61 makes the operating load required to slide the second rack 54 larger than the operating load required to slide the first rack 53. More specifically, in the case where the first document guide 51 is operated, the operating force transmits directly to the first rack 53. Therefore, if a large force corresponding to or greater than the sliding resistance increased by the protrusion 61 is applied, the first rack 53 can be slid.

On the other hand, in the case where the second document guide 52 is operated, the operating force transmits to the first rack 53 through the pinion 55. Therefore, the sliding resistance increased by the protrusion 61 increases due to the gear efficiency of the pinion 55.

Therefore, if the gear efficiency is intentionally lowered, for example, by reducing the backlash in the path of power transmission from the second rack 54 through the pinion 55 to the first rack 53, the second document guide 52 cannot be easily slid.

That is, by providing the protrusion 61 and regulating the gear efficiency, the operating load required to operate the first document guide 51 can be made small (e.g., relative to the operating load required to operate the second document guide 52), and the operating load required to operate the second document guide 52 can be made large (e.g., relative to the operating load of first document guide 51).

For example, when the sliding load required to slide the first rack 53 is 3 Newtons (N), the sliding load required to slide the second rack 54 is 0.5 N, and the gear efficiency between rack and pinion is 0.7, the operating load required to operate the first document guide 51 is 3+0.5/0.7/0.7=4.02 N. On the other hand, the operating load required to operate the second document guide 52 is 3/0.7/0.7+0.5=6.62 N. In one or more arrangements, the gear efficiency between the racks and pinion may be between 0.6 and 0.8 N, inclusive.

Therefore, if the operating loads required to operate the document guides 51 and 52 are made different by such a method, the user can slide the pair of document guides 51 and 52 relatively easily by operating the first (front) document guide 51.

When the ADF portion 7 is rotated with documents placed on the document tray 41, and the load of the documents acts on the second document guide 52, the second document guide 52 does not slide easily. Therefore, the documents do not slide down backward, and can be maintained in a state where they are held in proper position.

According to an embodiment as above, when the pair of first and second document guides 51, 52 are caused to slide, and when the second document guide 52 is operated, a large operating load is required compared to the case where the first document guide 51 is operated. For this reason, when ADF portion 7 is rotated with documents placed on the document tray 41, and the load acting from the documents on the second document guide 52 increases, the second document guide 52 does not slide as easily as the first document guide 51 does. Therefore, the possibility of rotating the movable body causing the second document guide 52 to slide is reduced, and documents can be more properly held between the pair of first and second document guides 51, 52.

The user can slide the pair of first and second document guides 51, 52 by sliding the first document guide 51 by applying a smaller operating load than in the case where the second document guide 52 is slid. Therefore, the user can easily perform sliding operation.

According to an embodiment as above, the resistance acting on the first rack 53 when the first rack 53 is slid is larger than the resistance acting on the second rack 54 when the second rack 54 is slid. As such, the first rack 53 is more difficult to slide than the second rack 54.

In this state, in the case where the first document guide 51 is operated, the operating load is applied directly to the first rack 53 extending from the first document guide 51. On the other hand, in the case where the second document guide 52 is operated, the operating load is applied to the first rack 53 extending from the first document guide 51 indirectly through the pinion 55.

For this reason, in the case where the second document guide 52 is operated, the transmission efficiency of operating load is likely to be lower. A correspondingly large operating load needs to be applied to the second document guide 52 in order to slide the first rack 53.

Therefore, the operating load required to slide the second document guide 52 is larger than the operating load required to slide the first document guide 51, and the second document guide 52 can be prevented from sliding when the movable body is rotated.

According to an embodiment, the contact pressure on a sliding part of the first rack 53 sliding relative to the document tray 41 is larger than the contact pressure on a sliding part of the second rack 54 sliding relative to the document tray 41. Therefore, the resistance acting on the first rack 53 when the first rack 53 is slid can be made larger than the resistance acting on the second rack 54 when the second rack 54 is slid, without requiring the sliding parts to be made of different materials. In one example, the different materials may have different coefficients of friction.

According to an embodiment as above, a protrusion 61 formed on the document tray 41 is the sliding part sliding relative to the first rack 53. Therefore, the contact pressure on the sliding part of the first rack 53 sliding relative to the document tray 41 is determined according to the amount of protrusion (e.g., 2 mm or less) of this protrusion 61. Therefore, by optimizing the amount of protrusion of the protrusion 61, a desired contact pressure can be applied on the sliding part of the first rack 53 sliding relative to the document tray 41.

Modifications

In the above embodiment, the sliding resistance of the first rack 53 is made larger than that of the second rack 54 by providing a protrusion 61. However, the sliding resistance of the first rack 53 may be increased by other methods, systems, devices and structures. In one example, the sliding resistance of first rack 53 may be increased by making the sliding part of the first rack of a material having a large friction coefficient. While some of the aspects herein have been described in relation to a sheet feeder, the same or similar aspects may be applied to other types of sheet holders.

In the above embodiment, the scanner unit 3 is incorporated in the multifunction device 1. However, the scanner unit 3 may form a single-function image scanner apparatus.

Figure 6B:
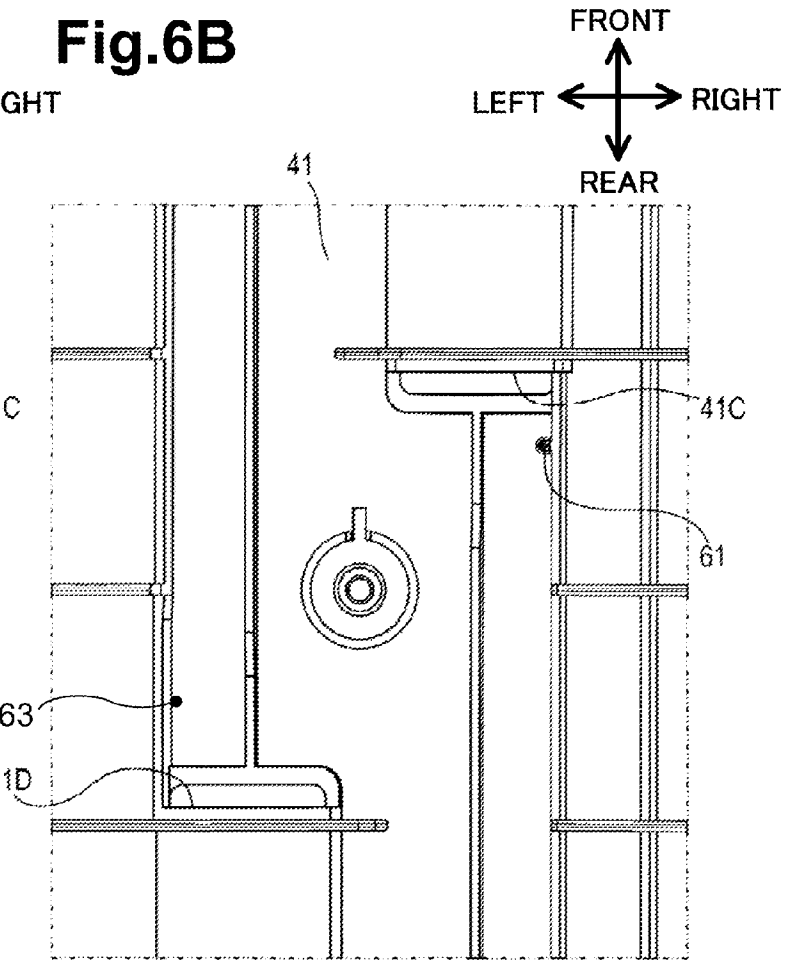
FIGS. 6A and 6B illustrate another example configuration of a sheet tray with document guides having a rack and pinion mechanism according to one or more aspects described herein.
Figure 6A:
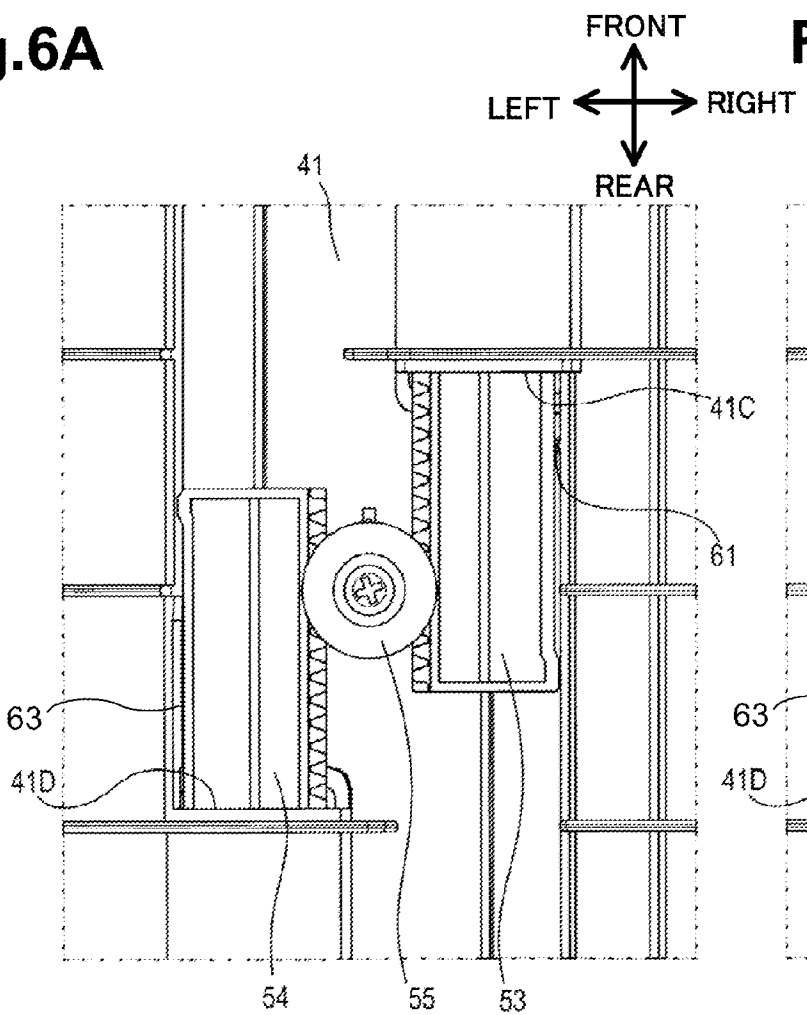

According to another aspect, a second protrusion may be provided on at least one of the second rack 54 and a portion of the sheet tray on which the second rack 54 is configured to slide. FIGS. 6A and 6B illustrate an example configuration where protrusion 63 protrudes from a portion of the sheet tray toward the second rack 54, such that a contact pressure is exerted on second rack 54 by protrusion 63. In such a configuration, the size of protrusion 63 may be smaller than a size of protrusion 61 so that the contact pressure on the second rack 54 caused by the protrusion 63 is lower than the contact pressure on the first track 53 caused by the protrusion 61. Additionally, in some arrangements, protrusion 63 may protrude from second rack 54 toward the sheet tray instead of the protrusion 63 protruding from the sheet tray toward the second rack.

In another aspect, a rigidity of the racks 53 and 54 may differ. For example, the rigidity of rack 54 may be less than the rigidity of rack 53. A lower rigidity may decrease the operating load required to move the corresponding rack. Accordingly, the operating load of second rack 54 may be decreased by lowering its rigidity and the operating load of the first rack 53 may be increased by increasing the material rigidity thereof. In one example, the second rack 54 may be composed of a Polystyrene High Impact (PS HI) material and the first rack 53 may be composed of a polycarbonate and/or Acrylonitrile Butadiene Styrene (ABS) plastic material.

In another example, instead of using a protrusion such as protrusion 61 or protrusion 63, a rubber material may be glued or otherwise attached to the sliding surface of the first rack 53 and/or the portion of the sheet tray on which the first rack 53 is configured to slide to provide additional frictional resistance. Additionally, a material having less frictional resistance may be glued or otherwise attached to the sliding surface of the second rack 54 and/or the portion of the sheet tray on which the second rack 54 is configured to slide.

While various aspects have been described, it is to be understood that the invention is not limited to the above specific embodiment and may be embodied in other various forms.

What is claimed is:

1. A sheet feeder comprising:

a sheet tray configured to hold one or more sheets;

a pair of sheet guides including a first sheet guide and a second sheet guide, the first and second sheet guides provided on an upper surface of the sheet tray and configured to slide along an axis perpendicular to a sheet conveying direction on the upper surface of the sheet tray, wherein sliding the first and second sheet guides causes a distance therebetween to change; and an interlock mechanism configured to move the first sheet guide in a first direction in response to movement of the second sheet guide in a second direction opposite the first direction, wherein the interlock mechanism comprises a first rack extending from the first sheet guide toward the second sheet guide and a second rack extending from the second sheet guide toward the first sheet guide, wherein the first sheet guide is configured to have a first operating load, the first operating load being required to move the first sheet guide, wherein the second sheet guide is configured to have a second operating load, wherein the second operating load is required to move the second sheet guide and is greater than the first operating load, wherein the sheet tray includes a protrusion extending in the sheet conveying direction toward the first rack and configured to continuously contact the first rack, and wherein the protrusion is fixed relative to the sheet feed tray so as to be immovable relative to the sheet feed tray.

2. The sheet feeder according to claim 1, wherein the interlock mechanism further includes a pinion meshing with both the first rack and the second rack, and wherein the first and second sheet guides and the interlock mechanism have such a structure that the resistance acting on the first rack when the first rack is slid is larger than the resistance acting on the second rack when the second rack is slid.

3. The sheet feeder according to claim 1, wherein the first rack and the second rack are configured to slide relative to the sheet tray, wherein a contact pressure on a portion of the first rack contacting the sheet tray is larger than a contact pressure on the second rack contacting the sheet tray, thereby causing the resistance acting on the first rack when the first rack is slid to be larger than the resistance acting on the second rack when the second rack is slid.

4. The sheet feeder according to claim 3, wherein the protrusion extends from a first portion of the sheet tray, wherein the first rack includes teeth configured to mesh with the pinion on a side opposite to the portion contacting the sheet tray, and wherein the first rack is configured to slide against the protrusion.

5. The sheet feeder according to claim 4, wherein the second rack is configured to slide on a second portion of the sheet feed tray, and wherein at least one of the second rack and the second portion of the sheet tray includes another protrusion, the other protrusion configured to generate the contact pressure on the second rack.

6. The sheet feeder according to claim 1, further comprising:

a movable body to which the sheet tray, the sheet conveying mechanism, the first and second sheet guides, and the interlock mechanism are assembled, wherein the movable body is pivotable in such a direction that an angle between the first and second directions and a horizontal plane increases and decreases.

7. The sheet feeder according to claim 1, wherein the at least one of the first portion of the interlock mechanism and the first portion of the sheet tray includes the material having the first coefficient of friction, and wherein the at least one of the second portion of the interlock mechanism and the second portion of the sheet tray includes the material having the second coefficient of friction.

8. An apparatus comprising:

a document tray configured to hold documents;

a document conveying mechanism that conveys the documents placed on the upper surface of the document tray from the document tray along a path of conveyance to a destination;

at least one of:

a scanner unit configured to scan an image from one or more of the documents conveyed by the document conveying mechanism; and an image formation unit configured to form an image on one or more of the documents;

a pair of sheet guides including a first document guide and a second document guide, wherein the first and second documents guides are provided on an upper surface of the document tray and are configured to slide along an axis perpendicular to the document conveying direction on the upper surface of the document tray, wherein sliding the first and second document guides is configured to change a distance therebetween;

an interlock mechanism configured to move the first document guide in a first direction in response to movement of the second document guide in a second direction opposite the first direction; and a movable body to which the document tray, the document conveying mechanism, the pair of first and second document guides, and the interlock mechanism are assembled and that is pivotable in such a direction that the angle between a sliding direction of the pair of first and second document guides and a horizontal plane increases and decreases, wherein the first document guide is configured to have a first operating load, the first operating load being required to move the first document guide, wherein the second document guide is configured to have a second operating load, wherein the second operating load is required to move the second document guide and is greater than the first operating load, and wherein the second document guide is disposed closer to a pivot axis of the movable body than the first document guide.

9. The apparatus according to claim 8, wherein the apparatus includes the scanner unit and further comprising a main body portion, wherein an upper surface of the main body portion serves as a placing surface on which a document can be placed, wherein the scanner unit is configured to scan an image from the document placed on the placing surface while moving along the placing surface, and wherein the movable body is openable and closable relative to the main body portion and is configured to function as a cover covering the placing surface when closed, wherein the movable body pivots in a direction such that the angle between the sliding direction and the horizontal plane increases when opened.

10. A sheet feeder comprising:

a sheet tray configured to hold one or more sheets;

a pair of sheet guides including a first sheet guide and a second sheet guide, the first and second sheet guides provided on an upper surface of the sheet tray and configured to slide along an axis perpendicular to a sheet conveying direction on the upper surface of the sheet tray, wherein sliding the first and second sheet guides causes a distance therebetween to change; and an interlock mechanism configured to move the first sheet guide in a first direction in response to movement of the second sheet guide in a second direction opposite the first direction;

wherein the first sheet guide is configured to have a first operating load, the first operating load being required to move the first sheet guide, wherein the second sheet guide is configured to have a second operating load, wherein the second operating load is required to move the second sheet guide and is greater than the first operating load, wherein at least one of a first portion of the interlock mechanism and a first portion of the sheet tray includes at least one of:

a protrusion extending in the sheet conveying direction and configured to generate a pressing force on the first portion of the interlock mechanism, and a material having a first coefficient of friction different from a coefficient of friction of a remainder of the at least one of the first portion of the interlock mechanism and the first portion of the sheet tray, and wherein at least one of a second portion of the interlock mechanism and a second portion of the sheet tray includes at least one of:

a protrusion extending in the sheet conveying direction and configured to generate a pressing force on the second portion of the interlock mechanism, and a material having a second coefficient of friction different from the first coefficient of friction and different from a coefficient of friction of a remainder of the at least one of the second portion of the interlock mechanism and the second portion of the sheet tray.

11. The sheet holding apparatus of claim 10, wherein the first portion of the interlock mechanism comprises a first rack and the second portion of the interlock mechanism comprises a second rack, wherein the first rack includes teeth configured to mesh with a pinion on a side opposite to a portion of the first track contacting the sheet tray.

* * * * *